United States Patent [19]

Vornberger

[11] Patent Number: 4,517,697

[45] Date of Patent: May 21, 1985

[54] ADHESIVE APPLICATOR

[75] Inventor: Walter Vornberger, Tewksbury, Mass.

[73] Assignee: International Shoe Machine Corporation, Nashua, N.H.

[21] Appl. No.: 541,850

[22] Filed: Oct. 14, 1983

[51] Int. Cl.[3] ..... B05C 5/04; B05C 5/02

[52] U.S. Cl. ..... 12/10.5; 12/12; 118/411

[58] Field of Search ..... 118/410, 411, 708, 710, 118/711; 12/12, 12.4, 10.5

[56] References Cited

U.S. PATENT DOCUMENTS

| | | | |
|---|---|---|---|
| 3,035,287 | 5/1962 | Vlcek et al. | 118/710 X |
| 3,302,225 | 2/1967 | Maifeld, Jr. | 118/411 X |
| 3,575,137 | 4/1971 | Marquis | 118/708 X |
| 4,227,483 | 10/1980 | Becka | 118/411 |

FOREIGN PATENT DOCUMENTS

| | | | |
|---|---|---|---|
| 2424324 | 12/1975 | Fed. Rep. of Germany | 118/411 |

*Primary Examiner*—John P. McIntosh

*Attorney, Agent, or Firm*—Robert Shaw

[57] ABSTRACT

A footwear forming machine wherein a shoe (or other footwear) upper assembly comprising a shoe upper draped about a last and an inner sole at the bottom of the last, is presented to the machine for applying adhesive and wiping of the lasting margin. The machine includes an inner sole support or footrest to receive the shoe upper assembly, means for stretching and forming the upper about the last and means for wiping the upper margin against the inner sole. An adhesive applicator mechanism is provided that include two extruder sections operable to apply adhesive to the bottom of the inner sole respectively near each edge of the toe portion of the shoe upper assembly. The two extruder sections are pivotally adjustable about a pivot point between positions wherein the free ends thereof are positioned closer to one another to accommodate small shoe sizes and wider apart to accommodate larger shoe sizes to permit application of the adhesive close to the edge of the inner sole, the margin thereafter being wiped against the inner sole.

12 Claims, 6 Drawing Figures

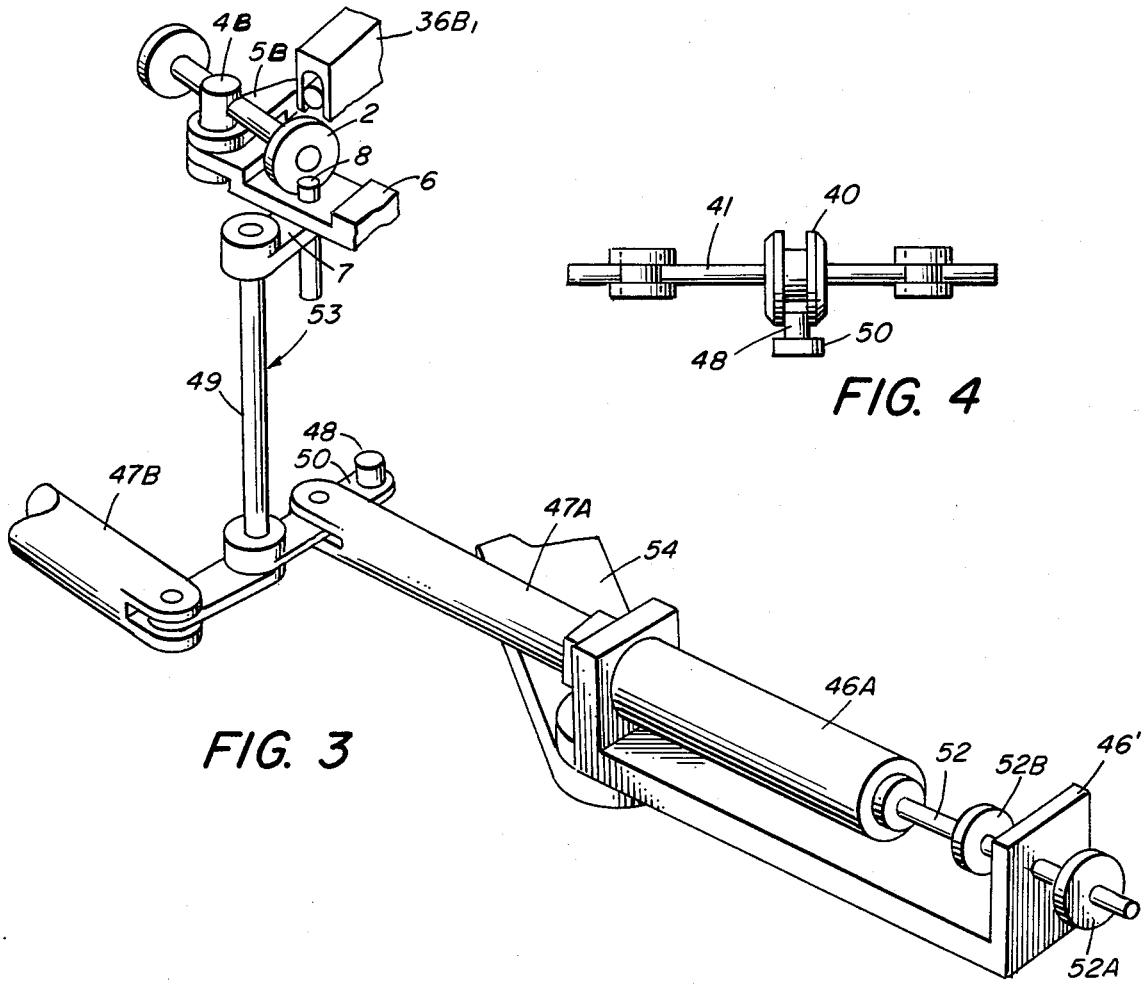
FIG. 3
FIG. 4
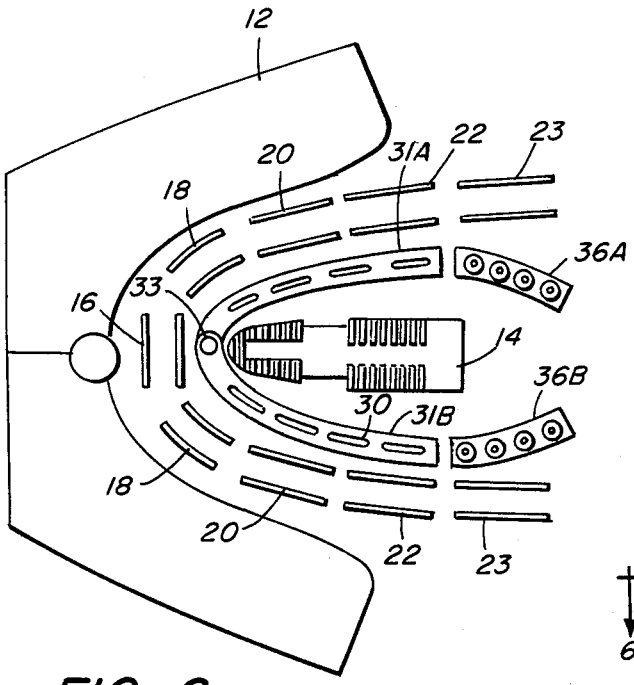
FIG. 6
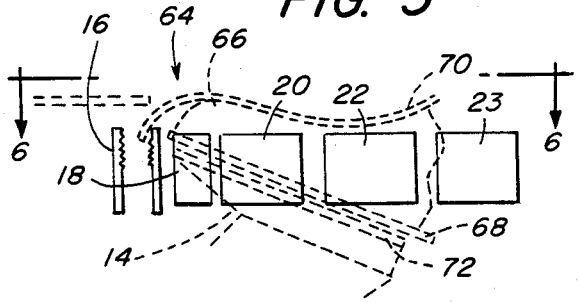
FIG. 5

ADHESIVE APPLICATOR

The present invention relates to adhesive applicators for shoe machines and the like.

To place the invention in context, attention is called to U.S. Pat. Nos. 3,157,897 (Morrill); 3,902,211 (Lindsey); 4,173,050 (Vornberger); 4,184,219 (Lindsey); 4,193,154 (Becka); 4,205,409 (Walega); 4,227,483 (Becka); and 4,391,012 (Becka).

In a typical shoe (or other footwear) forming machine of the type herein disclosed a shoe upper assembly consisting of a last with an upper draped thereon and an insole disposed on the last bottom is presented to the machine, bottom down, as shown in the Becka patent U.S. Pat. No. 4,391,012, for example. Pincers grasp the toe-end margin of the shoe upper assembly and stretch the vamp of the upper assembly about the last. An adhesive is applied to the edge portion of the insole bottom and the margin is wiped thereon. The adhesive is applied from the toe end of the inner sole to the ball portion thereof by an adhesive applicator which extrudes a hot adhesive onto the inner sole. In some machines provision is made to swing the applicator clockwise and counterclockwise to accommodate left and right shoes, but no provision is made to accommodate for different shoe sizes in the sense that changes in sizes result in changes in the shape of the toe portion of the inner sole bottom upon which adhesive should properly be applied. In the context of the present disclosure, the toe portion can, typically, include the actual toe of the shoe assembly, but can include, also, the forepart and, even, the ball area of the inner sole edge, it being understood that the concepts herein disclosed apply generally to apparatus to apply adhesive to the toe end of a shoe assembly.

Accordingly it is an object of the present invention to provide, in a shoe machine of the type disclosed, an adhesive applicator that can more closely conform than heretofore to the shape of the inner sole found in different sizes of shoes.

Still further objects are addressed hereinafter.

The foregoing objects are achieved, generally, in a footwear forming machine of the type disclosed wherein a footwear upper assembly that includes a footwear upper draped about a last and an inner sole at the bottom of the last is presented to the machine for applying adhesive and wiping of the lasting margin, said machine comprising an inner sole support to receive the footwear upper assembly; means for stretching and forming the upper about the last; means for wiping the upper margin against the inner sole; and an adhesive applicator mechanism that includes two extruder sections operable to apply adhesive to the bottom of the inner sole respectively near each edge of the toe portion of the footwear upper assembly, the two extruder sections being pivotally adjustable about a pivot point between positions wherein the free ends thereof are positioned closer to one another to accommodate small footwear sizes and wider apart to accommodate large footwear sizes to permit application close to the edge of the inner sole, irrespective of shoe size, the margin being thereafter wiped against the inner sole. In a modified version, the adhesive applicator mechanism includes two extruder extensions, one extruder extension being pivotally connected to the free end of each of the two adhesive extruder sections to form two articulated extruders.

The invention is hereinafter described with reference to the accompanying drawing in which:

FIG. 3 is an isometric view of some of the parts shown in FIG. 2;

FIG. 4 is a side view of some of the parts shown in FIG. 3;

FIG. 5 shows in schematic form a side view of a shoe assembly as it appears in the machine of FIG. 1 at the beginning of a machine cycle; and FIG. 6 is a view, again in schematic form, taken upon the line 6—6 in FIG. 5, looking in the direction of the arrows, of the important machine parts in FIG. 5 but with the shoe upper assembly removed.

Figure 1:
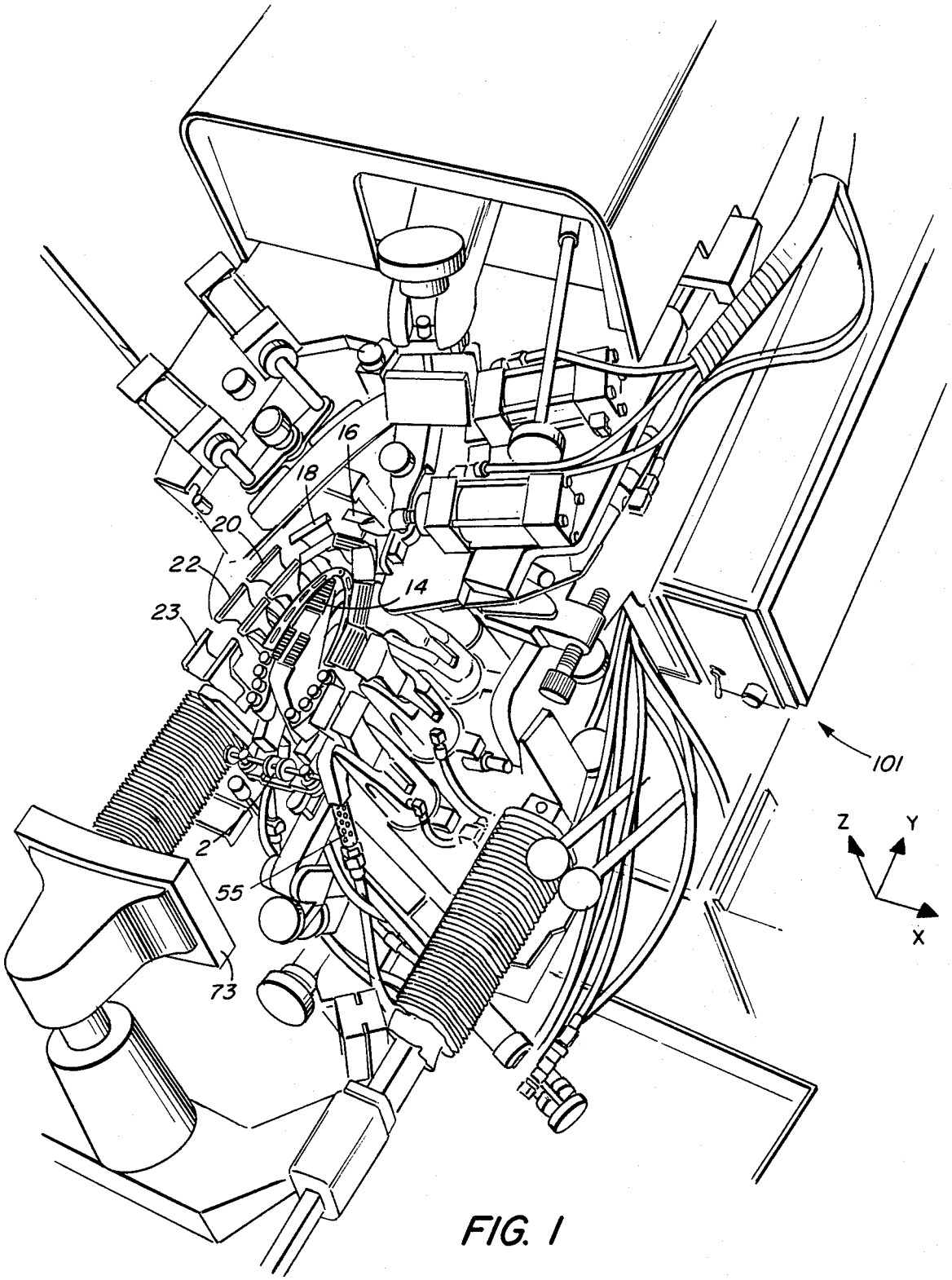
FIG. 1 is an isometric view of a portion of a shoe machine that embodies the present invention and that includes an adhesive applicator mechanism having two pivotally adjustable extruder sections with two extruder extensions pivotally connected to the ends of the two sections.

Turning now to FIG. 1. There is shown at 101 a portion of a footwear forming machine that embodies the present inventive concepts. The operator is intended to stand facing the machine 101 looking inwardly (i.e., in the plus Y-direction) from the bottom of FIG. 1. Machine parts closest to the operator are considered to be at the front of the machine and machine parts farthest from the operator are considered to be at the back of the machine. Parts moving toward the operator (i.e., in the minus Y-direction) are considered to have forward movement and parts moving away from the operator are considered to have rearward movement.

The machine 101 receives a shoe upper assembly 64 partially shown in broken-line form in FIG. 5, consisting of a last 66, an inner sole (or insole) 68 tacked or otherwise secured to the last, and a shoe upper 70 draped about the toe, forepart and ball areas of the last 66. The assembly 64 is presented, bottom down, with the inner sole 68 bearing against the top of an inner sole support or insole rest 14 (see also FIG. 6). The toe end extremity of the last bears against a toe bar (not shown) and the margin 72 of the upper 70 extends between the jaws of pincers 16, 18, 20, 22 and 23 in FIG. 6 which serve, in conjunction with other active elements of the machine 101, to stretch and form the upper 70 about the last 66. Later, as explained below, a hot adhesive is applied by an adhesive applicator mechanism 30 (FIG. 2) to the bottom of the inner sole 68 near the edge (or periphery thereof) at the toe portion of the shoe upper assembly, typically at the toe, the forepart and the ball area of the inner sole edge, against which the margin will later be wiped and adhered thereto.

Figure 2:
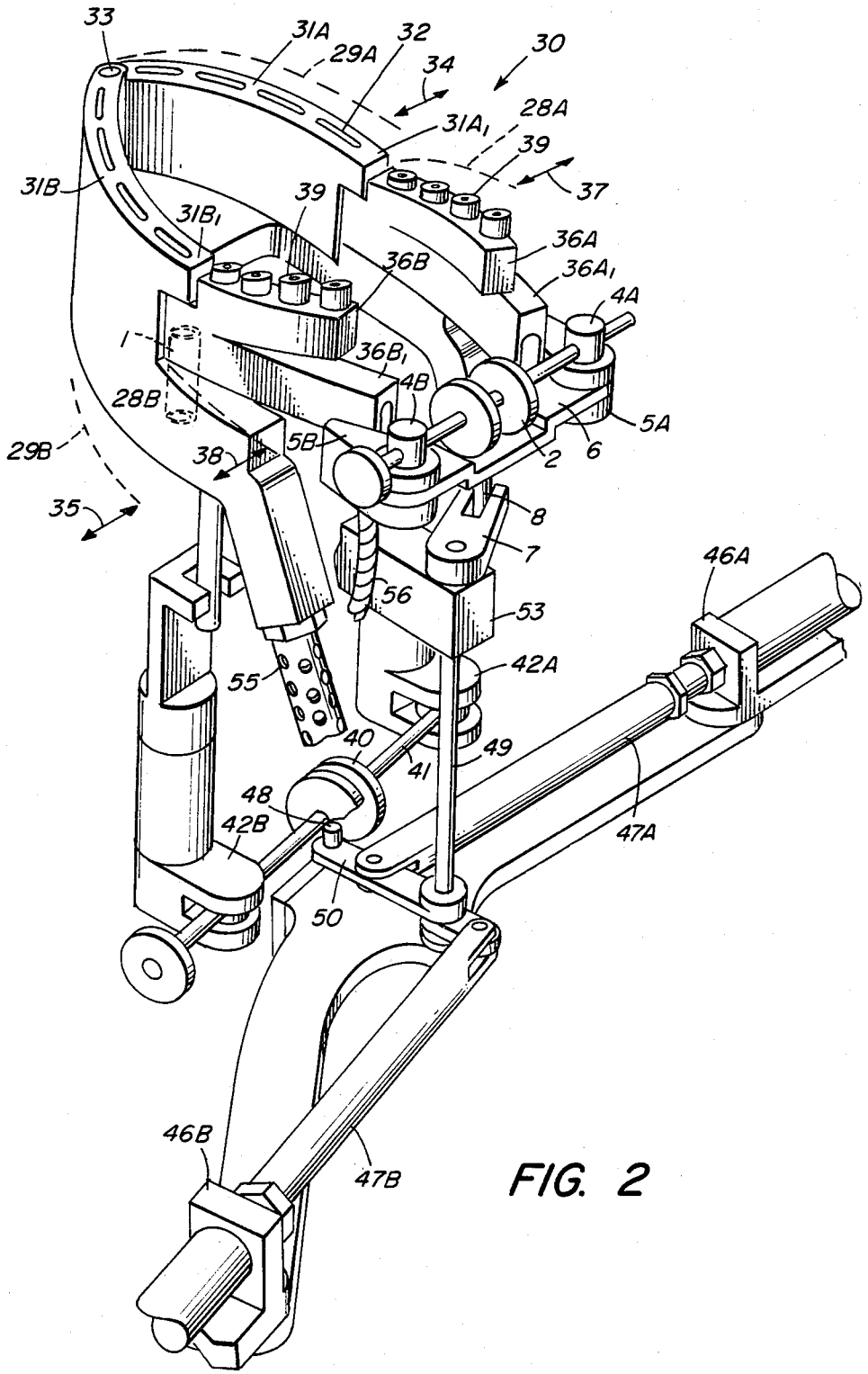
FIG. 2 is an isometric view of the two pivotally adjustable extruder sections and the two adjustable extensions plus closely related parts of the machine in FIG. 1.

The applicator mechanism 30, as shown in FIG. 2, includes two extruder sections 31A and 31B having ports 32 through which the hot adhesive flows when the mechanism 30 is pressed against the insole bottom. The two extruder sections 31A and 31B are pivotally adjustable about a pivot point 33 between positions wherein the free ends $31A_1$ and $31B_1$ thereof are positioned closer to one another to accommodate small shoe sizes and wider apart to accommodate larger shoe sizes (i.e., in the directions of double arrows 34 and 35 between the solid positions shown in FIG. 2 and the broken-line positions shown at 29A and 29B) to permit application of the adhesive close to the edge of the inner sole.

As explained below, the upper margin 72 is thereafter wiped (by wipers 12 in FIG. 6) against the inner sole (see, for example the Becka U.S. Pat. No. 4,391,012 for details).

The adhesive applicator mechanism 30 includes two extruder extensions 36A and 36B pivotally connected (e.g., by a hollow pivot 1) at the free ends $31A_1$ and $31B_1$ respectively, of the two adhesive extruders 31A and 31B, respectively, to form thereby two articulated extruders. The pivoted ends of the extensions 36A and 36B move with the extruder sections 31A and 31B to which they are pivotally attached, but the free ends thereof are independently adjustable, for example, as indicated by arrows 37 and 38, between the solid-line position shown in FIG. 2 and the broken-line positions indicated by broken lines 28A and 28B. Extruder ports 39 permit flow of adhesive onto the inner sole.

Adjustment of the extruders 31A and 31B is achieved by rotating an annular recessed disc 40 in FIGS. 2 and 4, which is secured to a threaded shaft 41 which rotates when the recessed disc 40 rotates. The shaft 41 is received by nuts 42A and 42B which move in unison either toward the disc 40 or away from it, depending on the direction of shaft rotation, thereby moving the free ends $31A_1$ and $31B_1$ toward or away from one another, as above explained.

Adjustment of the extensions 36A and 36B is achieved by an adjusting mechanism similar to that used for the extruders 31A and 31B. It includes an annular recess 2 between spaced discs secured to a threaded shaft 3 which is received by threaded pivots 4A and 4B in the ends labeled $36A_1$ and $36B_1$ of the extensions 36A and 36B, respectively. The shaft 3 rotates when the disc 2 rotates causing the ends $36A_1$ and $36B_1$ to move in unison toward or away from one another, thereby respectively reducing and increasing the separation of the ends $36A_1$ and $36B_1$. In this way the extruder extensions 36A and 36B can be adjusted independently of the corresponding extruder sections 31A and 31B to accommodate shoe sizes but also to account for shape differences between a left shoe and a right shoe, for example. The threaded pivots 4A and 4B are received by yokes 5A and 5B, respectively, which receive a slotted elongated plate 6, the slot serving to permit positioning of the pivots 4A and 4B (and hence the ends $36A_1$ and $36A_2$) along the plate 6. Nuts (not shown) thread onto the lower end of the pivots 4A and 4B to maintain their spatial position, once it is established in the manner described. As to the latter, there is a further correction that occurs in the machine 101, as now explained with reference to FIGS. 2, 3 and 4.

Let it be assumed that the articulated extruder in FIG. 2 is in the solid-line position for a particular shoe size and inner sole shape. Let it be assumed further that the solid-line position is correct for applying adhesive to a right shoe. The extruders 31A and 31B can be caused to swing to either the broken-line 29A or 29B or some other position by an air cylinder 46A whose shaft 47A moves in or out to move a lever 50 about a pivot 49, thereby causing a pin member 48 to swing one way or the other. The pin member 48 thus is caused to move left or right in FIG. 4, thereby swinging the extruders 31A and 31B accordingly. Manual adjustment nuts 52A and 52B, threaded along a shaft 52 in FIG. 3, control the amount of translational excursion of the shaft 47A and hence the amount of shift of the extruders 31A and 31B (i.e., the nuts 52A and 52B are threaded to move along the shaft 52 toward or away from a shoulder 46' which they strike when the shaft 47A moves to the left and right, respectively, in FIG. 3). The air cylinder 46A is anchored to the machine 101 by a structural member 54 in FIG. 3.

Swinging of the free ends of the extensions 36A and 36B is accomplished by an air cylinder 46B through a shaft 47B and a lever mechanism 53 that moves the recessed disc 2 (and thus the end $36A_1$ and $36B_1$) one way or the other to accommodate a particular shoe shape. Mechanical interaction between the lever mechanism 53 and the disc 2 is achieved through a yoke 7 that engages a pin 8 that extends upward through the plate 6 and (like the pin 48 in FIG. 2) engages the annular recess of the disc 2. In this way the disc 2 (and hence the ends $36A_1$ and $36B_1$) move in unison to the left or right in FIG. 2. The cylinder 46B has a manual adjustment mechanism that is identical to the cylinder 46A.

Once the shoe assembly 64 is in proper position on the insole rest 14, the pincers 16–23 grip the margin 72, then, as is explained in the Becka patent U.S. Pat. No. 4,391,012, the rest 14 is raised (i.e., moved in the plus Z-direction in FIG. 1) to stretch the upper over the last. At that juncture a heel clamp 73 is brought to bear against the heel end of the shoe assembly 64 and a toe hold-down is brought to bear against the top of the vamp of the shoe assembly 64; at about the same time, a pad is caused to clamp to toe, forepart and ball portions of the upper 70 against the last (see the Becka patent U.S. Pat. No. 4,391,012). Now the adhesive applicator mechanism 30 is caused to rise and to bear against the bottom of the inner shoe, after which a molten thermoplastic adhesive is caused to flow from the ports 32 and 39 onto the toe, forepart and ball portions of the periphery (i.e, near the edge) of the insole. Then the adhesive applicator mechanism is lowered to its idle position and wipers 12 in FIG. 6 are caused to swing forwardly and inwardly in a wiping stroke to wipe the upper margin against the inner sole, as discussed in the Letters Patent made of record above (e.g., Morrill U.S. Pat. No. 3,157,897 and Lindsey U.S. Pat. No. 3,902,211).

A few further matters not taken up above are addressed in this paragraph. An adhesive rod is delivered by hoses such as 55 (FIGS. 1 and 2) to the extruder sections 31A and 31B and thence to the extensions 36A and 36B through the hollow pivot 1 and a like pivot (not shown) for the extension 36B. The reference number 56 designates one of two electrical conductors to resistance heating elements within the extruders; the adhesive rod is melted within the thusly heated extruders and flows through the pivots as above noted. The heel clamp 73 in FIG. 1 has two air switches, one at each side of the clamp 73. When a left shoe assembly 64 is in place, a right switch is closed actuating the air cylinder 46A, thereby causing the extruder sections 31A and 31B in FIG. 2 to swing one way to accommodate that assembly; when a right shoe assembly 64 is in place, the other switch is closed actuating the air cylinder 46A, thereby causing the extruder sections 31A and 31B to swing to the other direction to match the shape of the right shoe assembly. Similarly, the air cylinder 46B positions the extensions 36A and 36B, but these extensions swing one way (e.g., clockwise) where the extruders 31A and 31B move the other (i.e., counterclockwise). The extruder sections 31A and 31B in the figures are in the form of curvilinear arrays of extruder ports, but straight line arrays can also be used.

Further modifications of the invention herein disclosed will occur to persons skilled in the art and all such modifications are deemed to be within the scope of the invention as defined by the appended claims.

What is claimed is:

1. In a footwear forming machine wherein a footwear upper assembly comprising a footwear upper draped about a last and an inner sole at the bottom of the last is presented to the machine for applying adhesive and wiping of the lasting margin, an inner sole support to receive the footwear upper assembly;

means for stretching and forming the upper about the last;

means for wiping the upper margin against the inner sole; and an adhesive applicator mechanism that comprises two extruder sections having respective toe ends and free ends operable to apply adhesive to the bottom of the inner sole respectively near each edge of the toe portion of the footwear upper assembly, the two extruder sections being pivotally adjustable at their toe ends about a single member pivot between positions wherein the free ends thereof are positioned closer to one another to accommodate small footwear sizes and wider apart to accommodate larger footwear sizes to permit application of the adhesive close to the edge of said inner sole, the upper margin being thereafter wiped against the inner sole;

said extruder sections having adhesive opening means extending from respective toe ends and said machine having said pivot member rotatively and directly connecting said toe ends to each other and to said machine for adjustable convergence or divergence of said extruder sections to accommodate pointed shoe widths.

2. In a machine according to claim 1, an adhesive applicator mechanism that includes two extruder extensions, one extruder extension being pivotally connected to the free end of each of the two adhesive extruder sections to form two articulated extruders.

3. In a machine according to claim 2, means to effect manual adjustment of the two extruder sections about said pivot member to accommodate differing sizes of footwear.

4. In a machine according to claim 3, means to effect manual adjustment of the two extruder extensions substantially independent of the manual ajustment of the two extruder sections.

5. A machine according to claim 4 in which the manual adjustment of each extruder extension is such that the ends of each extension are caused to move simultaneously either toward or away from one another.

6. In a machine according to claim 2, means to swing the adhesive applicator mechanism clockwise and counterclockwise automatically about said single pivot member to permit application of adhesive onto a ball section of the innersole of either a left footwear or a right footwear.

7. In a machine according to claim 6, first manual means to adjust the amount of swing of the two extruder sections about said single pivot member and second manual means to adjust the amount of swing of the two extruder extensions independent of the swing of the two extruder sections.

8. In a footwear-forming machine as set forth in claim 1, including two extruder extensions, one extruder extension being pivotally attached to each extruder section to form two articulated extruders; and means to swing the two extruder sections in unison about said pivot member and the two extruder extensions in unison to accommodate left footwear and right footwear.

9. Apparatus according to claim 8 wherein said means to swing comprises means to achieve automatic swinging of the two extruder sections and means to achieve automatic swinging of the two extruder extensions independent of the swing of the two extruder sections in the course of the forming process to accommodate the left footwear or the right footwear, respectively.

10. Apparatus according to claim 9 having first manual means operable to adjust the amount of swing of the two extruder sections about said single pivot member and second manual means operable to adjust the amount of swing of the two extruder extensions.

11. Apparatus according to claim 10 in which the means to achieve automatic swinging of the two extruder sections comprises an air cylinder coupled to the two extruder sections and the means to achieve automatic swinging of the two extruder extensions comprises further an air cylinder coupled to the two extruder extensions.

12. In a footwear forming machine as set forth in claim 1, an adhesive applicator mechanism that includes two extruder extensions, one extruder extension being pivotally connected to the free end of each of the two extruder sections to form two articulated extruders, pivotal connection means comprising hollow pivots between said extruder sections and respective extruder extensions for adhesive passage therebetween.

* * * * *